US005318084A

United States Patent [19]

Jackson

[11] Patent Number: 5,318,084

[45] Date of Patent: Jun. 7, 1994

[54] SHOULDER STRAP WITH INTEGRAL POCKETS

[76] Inventor: William S. Jackson, 227 N. Grove St., Ypsilanti, Mich. 48198

[21] Appl. No.: 982,859

[22] Filed: Nov. 30, 1992

[51] Int. Cl.[5] ..... A45C 1/04; A45C 13/28; A45C 13/30

[52] U.S. Cl. ..... 150/109; 150/102; 224/151; 224/203; 224/206; 224/264

[58] Field of Search ..... 150/109, 110, 111, 102, 150/107, 108; 294/137; 224/151, 203, 206, 264, 908, 918; 206/316.1, 316.2, 315.5

[56] References Cited

U.S. PATENT DOCUMENTS

| | | | |
|---|---|---|---|
| 417,301 | 12/1889 | Weldon | 224/206 |
| 1,703,540 | 2/1929 | Pierce | 206/315.5 |
| 1,797,359 | 3/1931 | Meyers | 224/206 X |
| 2,351,158 | 6/1944 | Stelzer | 150/102 X |
| 2,671,486 | 3/1954 | Shaw | 224/264 |
| 2,676,737 | 4/1954 | Zirbel | 224/264 |
| 2,745,456 | 5/1956 | Rubin | 150/35 |
| 3,575,326 | 4/1971 | Chappell | 224/205 X |
| 3,796,357 | 3/1974 | Johnson | 224/206 |
| 4,046,296 | 9/1977 | McGhee | 150/102 X |
| 4,085,872 | 4/1978 | Foo | 224/205 |
| 4,094,351 | 6/1978 | Catenaccio | 224/205 |
| 4,164,308 | 8/1979 | Gautier | 224/45 |
| 4,431,041 | 2/1984 | Leiserson | 224/264 X |
| 4,515,300 | 5/1985 | Cohen | 224/151 |
| 4,634,031 | 1/1987 | Frankhouse | 224/203 X |
| 4,700,761 | 10/1987 | Gladding | 150/111 |
| 4,722,464 | 2/1988 | Wright | 224/203 X |
| 4,756,458 | 7/1988 | Clifton | 224/206 X |
| 4,998,653 | 3/1991 | LaBelle | 224/151 |
| 5,129,564 | 7/1992 | Danezin | 150/108 X |

FOREIGN PATENT DOCUMENTS

| | | | |
|---|---|---|---|
| 1056923 | 5/1959 | Fed. Rep. of Germany | 206/316.1 |
| 1092295 | 11/1960 | Fed. Rep. of Germany | 206/316.1 |
| 2835276 | 11/1979 | Fed. Rep. of Germany | 224/151 |
| 2595220 | 9/1987 | France | 150/107 |
| 2641955 | 7/1990 | France | 224/205 |
| 527910 | 10/1940 | United Kingdom | 224/264 |
| 2000435 | 1/1979 | United Kingdom | 294/137 |
| 2157942 | 11/1985 | United Kingdom | 224/206 |
| 2182552 | 5/1987 | United Kingdom | 206/316.2 |

*Primary Examiner*—Sue A. Weaver
*Attorney, Agent, or Firm*—Krass & Young

[57] ABSTRACT

A shoulder strap with integral organizer enclosure for attachment to luggage and the like. The enclosure has several zippered compartments for holding personal items which are frequently needed during travel. When worn over the shoulder, the enclosure is disposed to one side of the a wearer's chest which makes the enclosure easily accessible to the wearer without requiring removal of the strap from the shoulder, even if the wearer has only one free hand. Additionally, the enclosure's location over the chest allows the user to easily monitor the pocket and its contents for peace of mind. The shoulder strap with integral organizer enclosure can also be worn around the waist as a utility pouch.

2 Claims, 2 Drawing Sheets

10
18
25
27
28
22
14

33
34
14
29
16
22
31
24
32
30
31
28
26
27
18
10
18

SHOULDER STRAP WITH INTEGRAL POCKETS

FIELD OF THE INVENTION

This invention relates to shoulder straps for luggage and, more particularly, to shoulder straps with pockets integrated into the straps.

BACKGROUND OF THE INVENTION

Travellers often carry an assortment of personal articles with them. These articles commonly include airline boarding passes, passports, glasses, pens and pencils, calendars, wallets, reading materials, medication, and the like. It is often inconvenient to carry so many items in clothes pockets, so the items are placed in carry-on luggage and briefcases. However, in the airport and on the airplane, it can be difficult to safely access carry-on luggage to remove these items. Producing a boarding pass is especially difficult for travellers with their hands full of carry-on luggage hurrying to board the airplane.

A small pouch mounted on the shoulder strap of the luggage is one solution to this problem. U.S. Pat. No. 4,164,308 to Gautier discloses a packet fastened to the strap of a lady's handbag and U.S. Pat. No. 2,745,456 to Rubin discloses a coin purse attached to the carrying strap of a purse. Neither of these addresses the problems faced by travellers, as previously described. A third invention, disclosed in U.S. Pat. No. 4,700,761, consists of a bag with a shoulder strap wherein the shoulder strap is comprised partially of a conventional adjustable strap and partially of a long soft tubular enclosure. The strap and the enclosure clip together and can be worn over the shoulder to support the bag. As disclosed, the strap extends from the front of the bag diagonally upward across the wearer's chest while the tubular enclosure extends from the rear of the bag diagonally upward across the person's back. No provision is made for access to the tubular enclosure without removing the strap from the shoulder. In this invention, the weight of the bag is partially supported by the tubular enclosure, which can cause the enclosure to deform.

SUMMARY OF THE INVENTION

The present invention is directed to a shoulder strap for luggage with an integral enclosure attached thereto. The enclosure is a safe, convenient place to keep small personal items during travel. The enclosure is especially useful for holding a boarding pass so that the pass is visible to the flight attendant at boarding, circumventing the need to stop and set down bags and search through clothes pockets for the pass.

The strap preferably takes the form of a flat strip of flexible material with a fastener secured to each end. A suitcase, carry-on, briefcase, or the like equipped with mounting hardware such as D-rings may be securely attached to the fasteners at the ends of the strap and hung at a persons side from the shoulder.

An enclosure with a substantially flat back for securely holding small articles is attached to the strap, positioned such that when the strap is used as described, the enclosure extends between the shoulder and the waist to one side of the wearer's chest, with the back of the enclosure resting flat against or near the wearer's chest. In this configuration, the user is able to access the contents of the enclosure with one hand without removing the strap and bag from the shoulder. The strap extends completely through the pocket so that the pocket does not carry any of the load from the bag, and thus the pocket resists deforming.

DETAILED DESCRIPTION OF THE INVENTION

Figure 1:
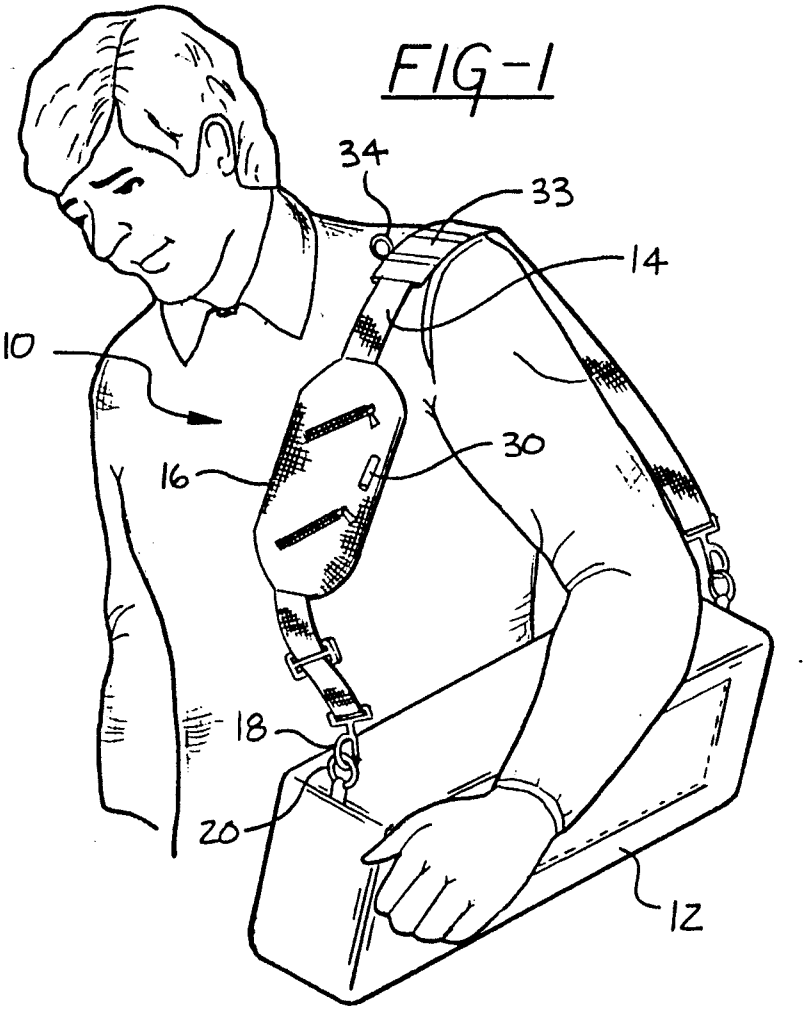
FIG. 1 is a perspective view of the preferred embodiment of the invention being used to carry luggage.

Referring to FIG. 1, a preferred embodiment of the present invention, a luggage carrier, generally indicated at 10, is shown being worn over the shoulder of a person to support a piece of luggage 12 which has been fastened to it. The carrier 10 is comprised of a strap 14 for supporting a load, such as luggage 12, and a compartmented enclosure 16 for retaining such articles as may be required by a traveller. The compartmented enclosure 16 is affixed to the strap 14 such that the bottom of the enclosure 16 is disposed near one end of the strap 14. The strap 14 is made from one piece of fabric and passes completely through the enclosure 16 so that the load of the luggage 12 is not carried by the enclosure 16 itself. The strap 14 transfers the entire weight of the piece of luggage 12 directly to the wearer's shoulder. The pocket 16 supports only the weight of the articles contained therein. By avoiding loading the enclosure 16 with the weight of the luggage 12, the shape of the enclosure 16 is not distorted and damage to delicate articles contained in the enclosure 16 is prevented.

When the carrier 10 is worn over the shoulder as a shoulder strap for luggage 12, the pocket 16 is disposed in a convenient position over the chest for the wearer to transfer items in or out of the enclosure 16 without removing the carrier 10 from the shoulder, even if the wearer has only one free hand with which to access the enclosure 16.

Figures 2A, 2B:
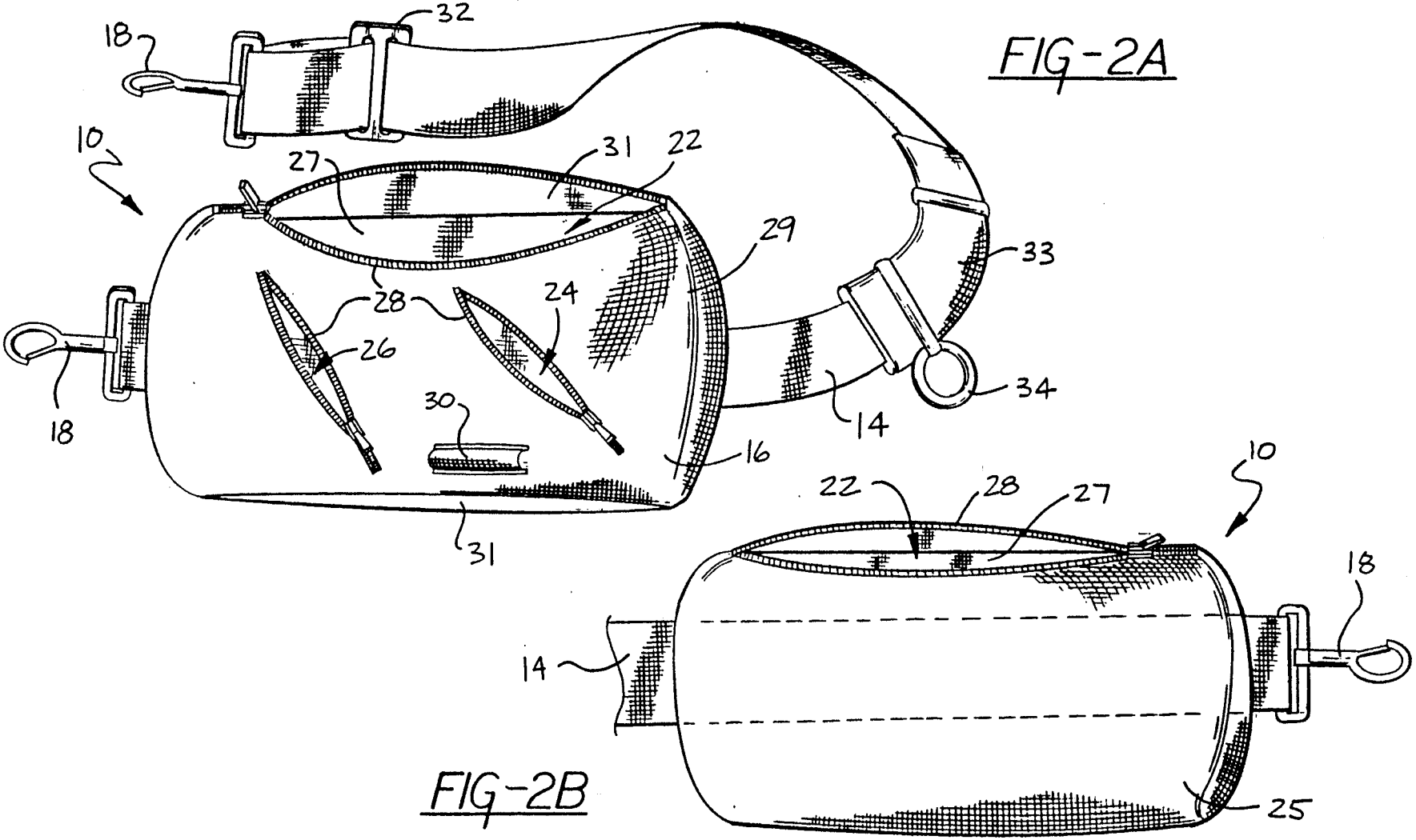
FIGS. 2A and 2B are a detailed front and rear view, respectively, of the preferred embodiment of the invention.

Referring now to FIG. 2, the details of the preferred embodiment of the carrier 10 are illustrated. Clip fasteners 18 on both ends of the strap 14 mate with any baggage, such as suitcases, duffel bags, briefcases, and the like, which is equipped with D-ring mounts 20 or equivalent hardware. The enclosure 16 has a plurality of compartments 22, 23, 24, 26 which are defined by partitioning the interior volume of the enclosure 16.

The enclosure 16 is constructed from three rectangular fabric panels layered in a stack and similarly oriented: a rear panel 25, a divider 27, and a front panel 29. To provide adequate depth for placing thick items inside the one compartment 22, two side panels 31 are stitched between the front 29 and divider 27 panels. The rear panel 25 and the divider 27 are sewn flush against each other. The strap 14 is placed flat along the longitudinal axis of the enclosure between the front 29 and divider 27 panels before the tops and bottoms of the three panels 25, 27, 29 are sewn together, thereby securing the strap 14 in place. The compartment 23 defined by the rear panel 25 and the divider 27 is accessible via a zipper 28 installed in the rear panel 25. A deep compartment 22 is defined by the interior volume between the front panel 29, two side panels 31, and the divider 27. This compartment 22 is accessible via a zipper 28 installed between one of the side panels 31 and the front panel 29. Additional pockets 24, 26 are arrayed on the front panel of the enclosure 16. Smaller panels are appliqued onto the front panel 29 to form pockets 24, 26, each provided with its own zipper 28. The zippers 28 on the openings prevent articles from accidentally coming out of the compartments 22, 23, 24, 26, although any closure means can be utilized to this end, such as hook and loop fasteners, buttons, laces, snaps, and the like. This invention should not be limited by the number, size, or arrangement of the compartments on the pocket.

A loop 30 is provided on the pocket's exterior to hold a pen or pencil. A writing implement can be clipped to the loop for easy access. This method for securing a pen or pencil is well known in the art.

The strap 14 has a length adjustment feature. At one end of the carrier 10, the strap 14 loops through the clip fastener 18 and doubles back on itself where it terminates at a slide 32 through which the strap material has been threaded. Moving the slide 32 along the strap 14 to increase the amount of strap 14 that is doubled over shortens the overall length of the carrier 10. A similar adjustment mechanism consisting of a fastener 33 and slide 34 is formed in the shoulder section of strap 14. This method of adjusting the length of a strap is known in the art. Any conventional method to adjust the strap 14 would work.

Figure 3:
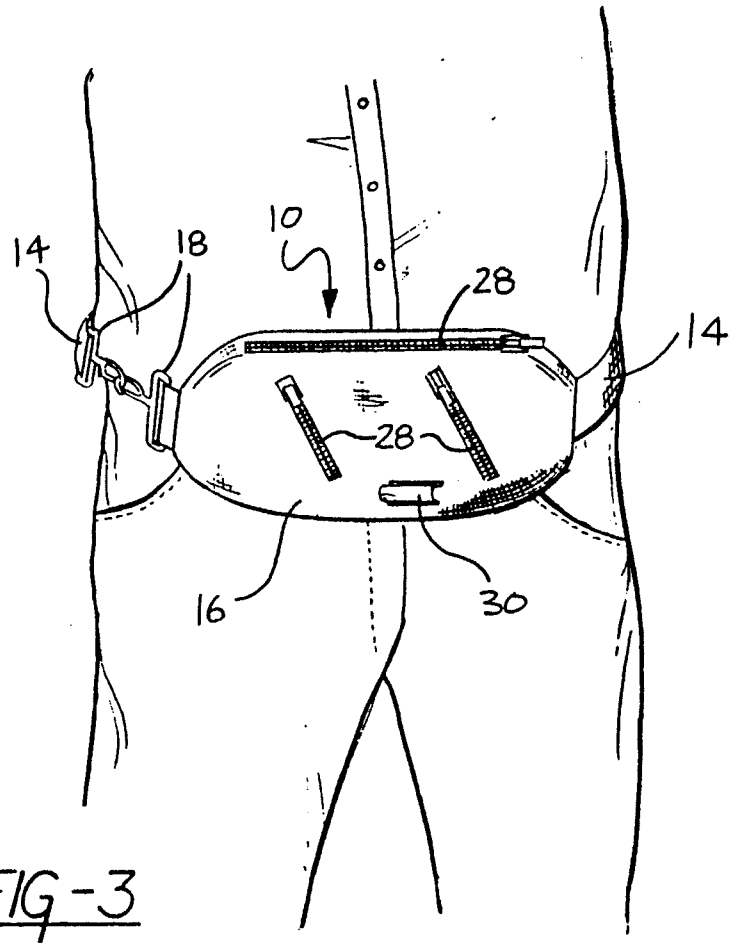
FIG. 3 is an illustration of the preferred embodiment of the invention being worn as a utility pack around the waist.

An alternative use for the carrier 10 is illustrated in FIG. 3. The strap 14 is placed around a person's waist and the two clip fasteners 18 are attached to each other. In this manner, the shoulder strap with integral pocket 10 serves as a waist utility pouch.

What is claimed is:

1. A combination shoulder strap and document retainer for use with an article carrier of the type including a pair of spaced fasteners, comprising:

an elongated, flexible, flat shoulder strap having a pair of separable fasteners complementary to said pair of spaced fasteners on said article carrier, the separable fasteners being affixed to the ends of the strap to allow attachment of said ends of the strap to the article carrier so that said strap may be arrayed over the shoulder of a user to support the article carrier along the user's side; and a document retainer formed of a plurality of layered flexible sheet sections secured to one another at their edges so as to overlie one another to form a flat enclosure, said strap passing completely through said enclosure and being secured to said document retainer at said edges of said sheet sections so as to support the document retainer on the strap, said flat enclosure further including an outer surface having an opening formed in the surface to allow insertion of and removal of documents into the retainer, the dimension of the retainer along an axis lateral to the longitudinal axis of the strap being greater than the width of the strap and the lateral edges of the retainer extending beyond the lateral edges of the strap so as to flatly overlie the user's chest when the strap is arrayed over the users shoulder and said pair of separable fasteners are attached to said pair of spaced fasteners of said article carrier.

2. The combination shoulder strap and document retainer of claim 1 in which said plurality of layered flexible sheet sections further include at least three said sheet sections to partition said enclosure and form a plurality of compartments for the receipt and retention of multiple documents, each said compartment having an opening to said outer surface of the retainer.

* * * * *